US006557301B1

(12) United States Patent
Hörmann et al.

(10) Patent No.: US 6,557,301 B1
(45) Date of Patent: May 6, 2003

(54) LOCKING DEVICE AND DOOR-DRIVE DEVICE COMPRISING THE SAME, FOR A DOOR OPERATED BY A MOTOR ASSEMBLY

(75) Inventors: Thomas J. Hörmann, St. Wendel (DE); Michael Sanke, Rheda-Wiedenbruck (DE); Viktor Schütz, Ansberg (DE)

(73) Assignee: Hörmann KG Antriebstechnik, Halle (DE)

( * ) Notice: Subject to any disclaimer, the term of this patent is extended or adjusted under 35 U.S.C. 154(b) by 0 days.

(21) Appl. No.: 09/973,607

(22) PCT Filed: Jun. 21, 2000

(86) PCT No.: PCT/DE00/02027

§ 371 (c)(1),
(2), (4) Date: Oct. 9, 2001

(87) PCT Pub. No.: WO00/79086

PCT Pub. Date: Dec. 28, 2000

(30) Foreign Application Priority Data

| | | |
|---|---|---|
| Jun. 22, 1999 | (DE) | 199 28 595 |
| Jul. 30, 1999 | (DE) | 199 36 055 |
| Aug. 20, 1999 | (DE) | 199 39 624 |
| Oct. 22, 1999 | (DE) | 199 51 054 |
| Oct. 25, 1999 | (DE) | 199 51 289 |

(51) Int. Cl.[7] ..... E05F 15/00
(52) U.S. Cl. ..... 49/139; 49/199
(58) Field of Search ..... 49/197, 198, 199, 49/200, 201, 139, 140; 160/188; 74/625

(56) References Cited

U.S. PATENT DOCUMENTS

| | | | | | |
|---|---|---|---|---|---|
| 3,235,246 | A | * | 2/1966 | Cowan | 49/197 |
| 3,909,980 | A | * | 10/1975 | Courtney et al. | 49/199 |
| 4,905,542 | A | * | 3/1990 | Burm et al. | 74/625 |
| 4,996,795 | A | * | 3/1991 | Niswonger | 49/199 |
| 5,544,924 | A | * | 8/1996 | Paster | 292/6 |

* cited by examiner

*Primary Examiner*—Jerry Redman
(74) *Attorney, Agent, or Firm*—Max Fogiel

(57) ABSTRACT

The invention relates to a locking device and a door-drive device comprising a locking device for a door which can be secured against opening by unauthorized persons using force from the exterior. The locking device has a lever element consisting of two lever arms which pivot about a first pivoting shaft. A connecting element is hinged to the first lever arm for connecting the door and the second lever arm which has an engaging device.

29 Claims, 6 Drawing Sheets

LOCKING DEVICE AND DOOR-DRIVE DEVICE COMPRISING THE SAME, FOR A DOOR OPERATED BY A MOTOR ASSEMBLY

BACKGROUND OF THE INVENTION

The present invention concerns a locking mechanism for a door driven by a motorized transmission, especially an overhead door, a tilting, swinging, or sectional door for instance, whereby the locking mechanism operates in conjunction with a coupling mechanism that couples the door's panel to a carrier, the transmission moves the carrier back and forth, preventing the closed door from opening when not subjected to force by the carrier, the locking mechanism includes a lever and a connector, the lever is mounted directly or indirectly on the carrier and pivots around a first axis in two opposite directions, the lever is provided with an engagement mechanism that engages a stationary counterbearing, the counterbearing operates in conjunction with a track that guides the carrier, locking the door, the engagement mechanism engages the counterbearing as the lever pivots in one direction and disengages it as the lever pivots in the opposite direction, the connector is rigid and is preferably in the form of a connecting rod, the connecting rod has an attachment mechanism at one end that attaches it to the door panel and is pivoted at the other end to the lever around another axis that is some distance from the first axis, whereby the lever accordingly pivots around the firstaxis in the first direction when the connector is pushed while in alignment with the door and in the opposite direction when the connector is pulled while in alignment with the door. The present invention also concerns a door-drive mechanism provided with such a locking mechanism. A locking mechanism and door-drive mechanism of this genus is known from European Patent 0 743 416 A1, which will be discussed in detail hereinafter.

Motorized drive mechanisms that open and close overhead doors have long been known.

A mechanism of this genus is known from DE 2 741 539 A1 for example. They usually include a carrier, preferably a carriage, that can be moved along the track positioned horizontal above the route traveled by the door. The carrier is usually attached to the door by connecting rods. Detaching the carrier from the door or from a traction mechanism between the carrier and the drive mechanism in the event of an emergency, when the mechanism malfunctions, has also long been known.

Problems can be encountered with such drive mechanisms. The closed door can be forced up from outside by muscle power, the carrier moving in the door-opening direction without or even against the force exerted by the transmission.

Additionally preventing the carriage and/or the closed door from unauthorized opening has accordingly often been proposed. Examples of such locking mechanisms are known from German Patent 1 961 916, U.S. Pat. No. 3,704,548, German 8 802 127 U1, French A 2 349 014, U.S. Pat No. 3,909,980, and the aforesaid European Patent 0 743 416 A1.

In German Patent 1 961 916, a carrier in the form of a carriage travels back and forth along a track between two stops. The closure stop is provided with a stationary pawl. The carriage is secured in its locking position when it engages the pawl. The engaged pawl is subject to tension. To disengage the carriage, it is attached by way of a two-armed lever to a traction mechanism between it and the motorized transmission. The lever's arms act as stops, limiting its pivoting motion. The free end of one arm engages below the pawl when the lever is in its locking position. When the traction mechanism is actuated, the lever pivots before the carrier begins moving. The pawl is accordingly lifted and disengaged, releasing the carrier. This drive mechanism is indeed provided with a coupling mechanism that couples a carrier in the form of a carriage to the door, but the coupling mechanism pivots around the same axis as the lever, although independently thereof.

In the mechanism disclosed in U.S. Pat. No. 3,704,548, it is the upper end of the door and not the carrier in the form of a carriage that is locked. Releasing the tensioned locking device again in order to open the door requires a highly complicated system of levers and slides.

German 8 802 127 U1 discloses a locking mechanism wherein a connecting rod attached to the door lifts a carrier when force is applied to the door from outside and accordingly engages the carrier with a cogged rack or with a chain above it. This locking mechanism is not completely reliable. The carrier can move at a right angle to its intended direction, resulting in unpleasant rattling and imprecise movement. The carrier can even tilt out of alignment and impinge on the rack or chain in ordinary operation.

French A 2 349 014 discloses a locking mechanism wherein the connecting rod that comprises the coupling mechanism travels back and forth in a slot in the carrier. A pawl on the connecting rod pivots around a pin accommodated in the slot and engages a counterbearing on the track. As the carrier leaves its locking position, the connecting rod is pulled along the slot, disengaging the pawl by way of a sloping plane. The mechanism known from U.S. Pat. No. 3,909,980 also employs means of displacement comprising a pawl in conjunction with a slot and a sloping plane to lever the pawl out of its engagement against a counterbearing. Generally, devices of this genus, which exploit displacement of a rod in relation to a carrier, are problematic with respect to wear and are complicated to manufacture and to install and adjust on site.

The locking mechanism of the aforesaid genus known from European Patent 0 743 416 A1 on the other hand has proven very reliable and easy to manufacture and install. The connecting rod employed therein between the carrier and the door is not directly attached to the carrier but to a lever that pivots around an axis on the carrier. A coupling mechanism constituting a toggle composed of the rigid connector, which is in the form of a connecting rod, and the lever, couples the carrier to the door. The lever has only one arm and is provided with a hooked pawl in the vicinity of another pivoting axis and engaging a notch in the vicinity of the track. This mechanism has few moving parts, and they only pivot among themselves and are not relatively displaced. The mechanism is accordingly very simple and operates reliably in that, with the exception of the pawl, none of the components slide along any of the others, which would subject them to wear. The mechanism is also very easy to install and adjust.

Even this known mechanism, however, needs improvement with respect to its adaptability to various installation situations. The toggle for instance allows the connecting rod to rotate only to a limited extent without detriment to the function of the pawling system. This is of disadvantage in particular when the track is to be mounted high above the doorway. The site might also provide insufficient vertical space, in the opening and closing direction, that is, in which event a shorter connecting rod would be desirable. The limits dictated by the operation of the toggle will still be too narrow in some situations.

SUMMARY OF THE INVENTION

The object of the present invention is an improved locking mechanism and associated drive mechanism of the genus disclosed in European Patent 0 743 416 A1 that will operate just as reliably and that can be manufactured, installed, and adjusted just as easily while adapting readily to a wider range of situations on site.

This object is attained in accordance with the present invention in a locking mechanism of the aforesaid genus in that the lever comprises two arms, the connector being attached to the arm, and in that the mechanism that engages the counterbearing while or after the lever and hence the second arm pivots in the first direction, pushing the connector attached to the door, and that disengages the counterbearing while or after the lever and hence the second arm pivots in the opposite direction, pulling the connector attached to the door, is mounted on the second lever arm.

These amazingly simple measures allow the connector or connecting rod to be farther uncoupled from the lever. The connector, specifically the connecting rod, that is, can be attached to the door at a wider range of angles, while the lever is rotated in the first direction only when subjected to force in the opening direction.

A door-drive mechanism with a locking mechanism of this species can accordingly be installed considerably above the doorway and be provided with shorter connecting rods.

Advantageous embodiments of the present invention are addressed by the subsidiary claims.

Various types of engagement mechanism can be employed. The mechanism can for example be a pin that engages a barbed structure from a depression therein. In a simpler and preferred embodiment, however, the end of the second lever arm pointing along the first pivoting direction is provided with an engagement mechanism in the form of a hook or nose that hooks onto or engages behind the counterbearing while or after the lever pivots in the first direction and releases it while or after the lever pivots in the second direction.

To facilitate directly transmitting the pushing and pulling forces from the carrier to the door by way of the coupling mechanism, the lever and connecting rod, that is, during normal operation, one advantageous embodiment of the locking mechanism in accordance with the present invention features two stops, the first stop limiting the motion of the lever as it pivots in the first direction once engagement has been achieved and the second stop limiting the motion of the lever's first and/or second arm as it pivots in the second direction once engagement has been achieved. The lever can accordingly pivot only to a limited extent, just far enough to engage or disengage.

The regulations that govern the safe operation of doors driven by motorized drive mechanisms prescribe that the doors can be opened in emergencies and when their drive mechanisms malfunction. This demand is of particular importance when the door is the only form of access to the other side. For such events, one particularly advantageous embodiment of the drive mechanism in accordance with the present invention features an emergency unbarring mechanism that disengages the lever, allowing the door to be opened by muscle power. The locking mechanism can accordingly be released when the drive mechanism malfunctions, in the event of a power failure for example, and the drive mechanism will not stand in the way of opening the door by muscle power. Since many door-drive mechanisms are self-inhibiting, however, it is not only the locking mechanism itself that must be overcome when opening the door by muscle power, but the motorized transmission itself. It will accordingly be of advantage for the emergency unbarring mechanism that unlocks the locking mechanism and uncouples the door to be constituted by the motorized transmission itself. It will be of further advantage in this case for the emergency unbarring mechanism to be provided for this purpose with a separating mechanism that separates the carrier from the motorized transmission. The separating mechanism in one preferred embodiment can be provided with an unlocking-lever component that manually shifts the carrier out of a normal position, wherein the carrier is coupled to the motorized transmission, and into a detachment position, wherein the carrier is detached from the motorized transmission, especially by traction means. The separating mechanism can for example be actuated by way of manually actuated traction means. The traction means can for example comprise a traction cord accessible from inside the door and/or a Bowden cord accessible from outside. Other means—levers, rods, etc. for example—of actuating the emergency unbarring mechanism are of course also conceivable. Although manual actuation is preferred, automatic actuation by way of an emergency mechanism of some sort is also possible.

To ensure that the locking mechanism can be unlocked to allow the door to be opened by muscle power, the emergency unbarring mechanism in one embodiment of the present invention can include means of applying tension, especially in the form of a spring that maintains the lever in its release position. The engaging component in all known locking mechanisms is maintained in its engaged position subject to tension. Although this feature does ensure that the engagement mechanism will engage and remain engaged as long as the door remains closed, it is not absolutely necessary in that the engagement mechanism must only remain engaged while the door is actually subjected to force from outside. If, for example, as provided in this particular embodiment of the present invention, the lever is maintained in its release position by tension, the advantage will be that the door can easily be opened by muscle power with the carrier coupled by way of the traction mechanism without having to first shift the engaging mechanism out of its engaged position. All that would be necessary to disengage the system in an emergency in such an embodiment would be to uncouple the carrier from the motorized transmission.

Practice has demonstrated, however, that this theoretically simplest approach is not sufficient in all cases to ensure absolutely reliable emergency unbarring. The emergency unbarring mechanism in one preferred embodiment of the present invention can accordingly include an unlocking mechanism that will when actuated shift and in particular force the lever out of its engaged position or locking position, whereupon the door panel can be pulled or pushed up, allowing the door to be opened subject to muscle power in an emergency.

The unlocking mechanism is also preferably designed such that, when the emergency unlatching mechanism is actuated, by tugging on the traction means for example, it will not pivot the second lever arm out of its engagement position and into its release position until the separating mechanism has separated the carrier. The emergency unbarring mechanism can accordingly be operated in two phases. In the first, the carrier is uncoupled from the motorized transmission. In the next phase, as the emergency unbarring mechanism continues to be actuated, by continuous tugging on the traction means for example, the locking mechanism will be unlocked. The unlocking mechanism that unlocks the locking mechanism in one concrete and advantageous embodiment is mounted on, located on, or associated with the unlocking-lever component that unlocks the carrier from the motorized transmission such that it will not, as the unlocking-lever component pivots out of its normal position and beyond its unlocking position, seize a vicinity of the lever that pivots along with the second lever arm such that the second lever arm will pivot in the second direction, until the unlocking-lever component has traveled beyond its unlocking position. In the simplest version of this embodiment, both the unlocking mechanism and the unlocking-lever component comprise a single component, that will, as it pivots out of its normal position around an acute angle, uncouple the carrier from the motorized transmission and, as it continues beyond that angle, seize the locking mechanism's lever and force it out of its engagement position. In the simplest version, the unlocking mechanism is constituted by the unlocking-lever component itself, whereby once it has traveled beyond its unlocking position, the unlocking-lever component will directly seize the lever and push or pull it out of its engagement position. The unlocking-lever component in one preferred embodiment can be pivoted manually, especially by way of the traction means. The unlocking-lever component is connected to a coupling pin. The pin is in particular tensioned in the coupling position and couples the carrier to the traction mechanism. As it pivots into the unlocking position, the unlocking-lever component releases the pin. The unlocking-lever component is preferably provided with a contact vicinity that contacts a matching contact area on the lever, pivoting the second lever arm out of its engagement position and into its release position.

The contact area of the lever that constitutes the locking lever in another preferred embodiment is provided with a third lever arm that is connected to and pivots along with the second lever arm around the first axis. The third lever arm extends into the vicinity wherein the unlocking-lever component pivots such that, when the lever is in its engagement position and the unlocking-lever component in its normal position, the third arm will be far enough from one arm of the unlocking-lever component to allow emergency unbolting to take place in two phases. It is in this event preferable for the distance to be long enough to prevent the unlocking-lever component and the third lever arm from seizing each other until the unlocking-lever component has pivoted out of its normal position and beyond its unlocking position such that the second arm of the lever can be released as the unlocking-lever component continues pivoting.

One concrete embodiment of the present invention features a bearing that accommodates the lever, whereby the bearing extends downward from the carrier when the mechanism is employed as intended, the carrier travels back and forth along a track, the track extends horizontally above the route traveled by the door panel as the door opens, the first axis is provided against the bearing extending downward as viewed from a specified angle and at a distance from the horizontal track when the mechanism is employed as intended, and the first and/or the second axis are preferably provided on the bearing. This situation can be attained for example if the bearing is provided with a housing in the form of a sleeve or is sleeve-like or cylindrical, with the lever coming to rest against the interior wall surface of the housing upstream and/or downstream and above and/or below the axis during the pivoting motion.

Instead of the bearing that establishes a position below the carrier track. The first axis can be accommodated inside the carrier itself. In this case, the lever will be accommodated inside the carrier. The interior wall surfaces of the housing that face the first lever arm will preferably act as the first and/or second stop. The second axis will, however, preferably be below the carrier track when the mechanism is employed as intended.

The first lever arm in one especially advantageous embodiment can extend for this purpose downward, essentially downward, that is, from the first axis in when the mechanism is employed as intended such that, as it pivots in the first direction, its free end will move in the opening direction traveled by the carrier. The lever arm need not point precisely downward but only essentially downward, extending across the direction traveled by the door panel and/or the carrier and accordingly transmitting the maximum of torque. Due to the force exerted on the connecting rod during the first attempt to open the door from outside, the first lever arm will pivot into the premisses being closed off.

The second lever arm can extend upward, essentially upward, that is, from the first axis for example when the mechanism is employed as intended such that, as the arm pivots in the first direction, its free end will move along with the engagement mechanism opposite the direction traveled by the carrier until it arrives in its engagement position. The first and second lever arm in one embodiment of the present invention can thereby extend essentially perpendicular to each other, more or less at 180°, at least in the vicinity of the first axis. This approach will simplify manufacture of the lever, which will act like a motion-reversing lever.

The lever arms in one advantageous embodiment either constitute a simple single component or are otherwise fastened together, pivoting as a whole in both directions.

The first and second lever arms in one alternative embodiment, however, can be separate components coupled together. They will then preferably be coupled together by way of a carrier mechanism such that the second lever arm will move along with the first lever arm only when pivoting in one particular direction. It is accordingly preferably subjected to tension such that both lever arms will engage each other by way of the carrier mechanism. When force is exerted against the second lever arm in opposition to the engagement provided by the carrier mechanism, however, the latter will pivot out of engagement with the first lever arm. It will in this case be preferable for both the first and second lever arm to pivot simultaneously as the carrier travels in the opening direction and to uncouple from each other, especially by pivoting relative to each other, as the carrier travels in the closing direction. The advantage here is that the second lever arm can slip beyond the counterbearing and snap into place without having to carry the first lever arm and the connector coupled thereto along with it. Furthermore, the second lever arm, once uncoupled from the first lever arm by the emergency release mechanism comprising the unlocking mechanism, can easily be shifted out of its engagement position without having to move the first lever arm and hence the coupling mechanism. With such an embodiment it is also conceivable in principle to eliminate two-phase actuation of the emergency unbolting mechanism or to unlock the locking mechanism first and then [un] couple the carrier from the motorized transmission. To ensure that the locking mechanism will remain locked in any case once the lever arms have been uncoupled, it will be preferable for the second lever arm to be tensioned, preferably by a spring, in its engagement position.

The free end of the second lever arm in another embodiment of the present invention is bent or curved along the first pivoting direction, creating the engagement mechanism, especially the hook, whereby the face of the bent or curved free end that faces the first direction is provided with a hook nose with an engagement area that seizes the counterbearing and locks it. The lever can accordingly as a whole comprise a straight, curved or, depending on the situation, bent, at an essentially right angle for example, strip of sheet metal that terminates in a hook. If the end is straight, it can act as a first lever arm for example, with a point of engagement, a bore for example, for the first axis located therein. In this case, the other end, which can be bent for example, will act as a hook that hooks onto the counterbearing as the lever pivots in the first direction. It is on the other hand also conceivable for the first and second lever arm to bend toward each other, with a bore or similar bearing for the first axis located in the vicinity of the bend. The entire second lever arm will in this case comprise a hook with a nose at the end. A third lever arm can be provided in the form of a straight extension of the second lever arm, representing a point of contact for the unlocking component.

To allow the hook to hook onto or the nose to travel beyond the counterbearing that it is to engage behind even while it is being advanced during normal operation, it will also be preferable to provide the engagement mechanism with a snap-in nose and in particular for the hook nose or nose to be in the form of a snap-in nose. The side of the snap-in nose that faces the engagement area can be provided with an on-ramp shoulder. If the engagement mechanism is also provided with an obliquely angled capture area for seizing the counterbearing, the second lever arm will not be able to hook over the counterbearing subject to powerful force as might happen if a pointed capture area were to bore into the counterbearing. Tests have indicated that reliable locking can be attained even with an obliquely angled capture area.

It will be preferable to be able to fasten the counterbearing at various points along the track. The track can for example be a rail in the form of a length of C section, the counterbearing tensioned across it from one mutually facing edge to the other. An embodiment of the present invention is preferable wherein the counterbearing simultaneously constitutes or comprises a limiting mechanism that limits the closing motion of the carrier and accordingly prescribes its closing position. It will also be preferable for /27. the counterbearing to be constituted by one edge of the limiting mechanism and especially by an edge that extends into the C section.

The locking mechanism can be adapted to various sites even more easily if /28. the connecting rod is provided with several means of attaching it to any desired point on the door panel and of articulating it to any desired point on the first lever arm. This feature will be even more advantageous if it allows various distances between the door panel and the carrier to be spanned. T /29. he connecting rod in one concrete version is preferably flat and elongated and in particular a perforated strip of metal, whereby the means of attaching it to any desired point on the door panel and of articulating it to any desired point on the first lever arm are in the form of several preferably round holes distributed along it.

BRIEF DESCRIPTION OF THE DRAWINGS

Various embodiments of the present invention will now be specified by way of example with reference to the accompanying drawing, wherein.

DESCRIPTION OF THE PREFERRED EMBODIMENTS

Figure 1:
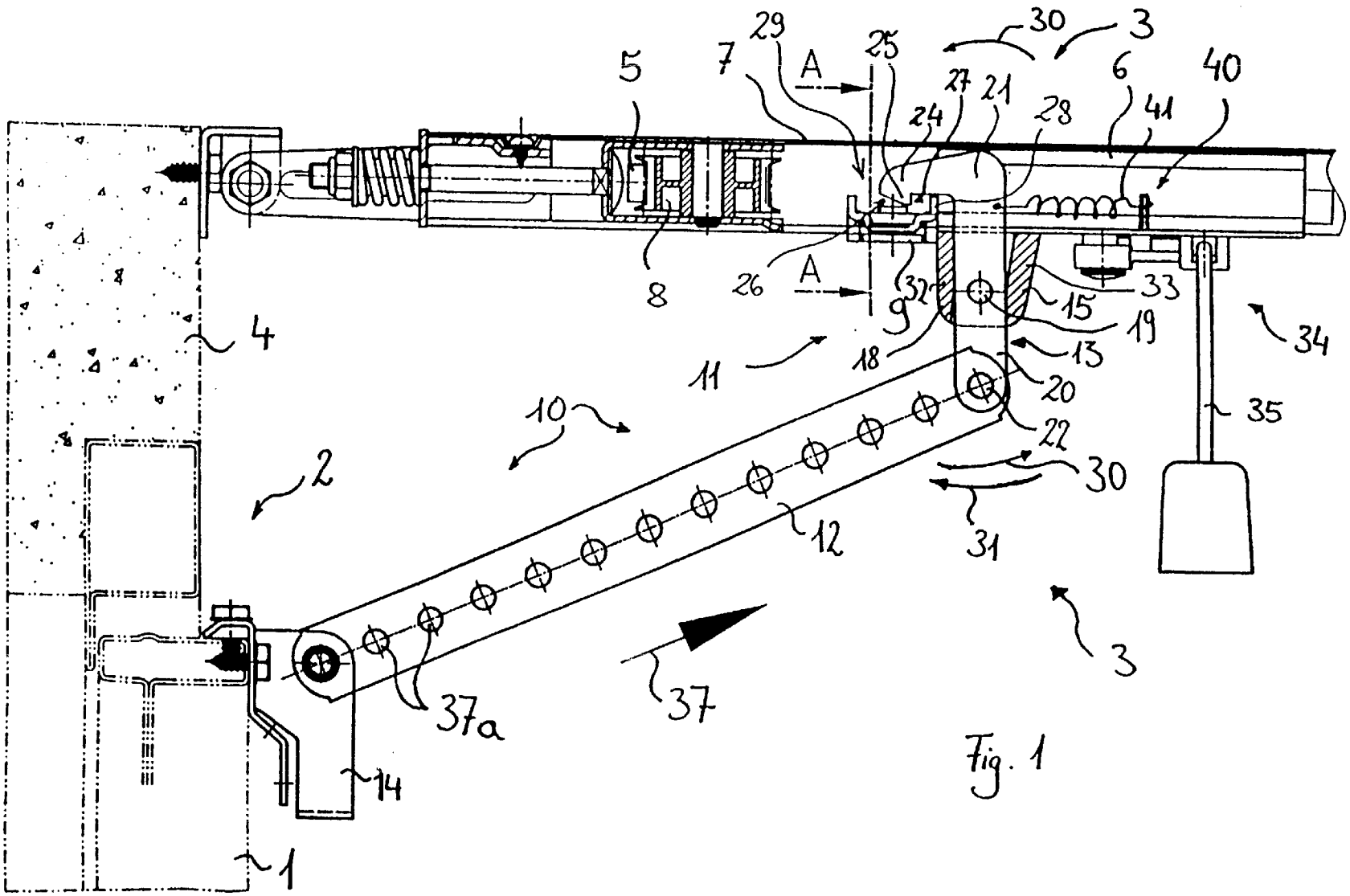
FIG. 1 is a partly sectional lateral view of part of one embodiment of a door-drive mechanism and locking mechanism adjacent to a doorway during an attempt to open the door from outside subject to muscle power.

The figures illustrate various embodiments of a drive mechanism 3 for an overhead door 2 in the vicinity of its attachment to the door's panel 1. More specifically, only the end of drive mechanism 3 that is to be fastened to the doorway's lintel 4 is represented. At the other end, the drive mechanism 3 is provided with an unillustrated motorized transmission that shifts a carrier in the form of a carriage 6, 106, or 206 back and forth between two limits, specifically a door-opening position and an illustrated door closing position subject to a traction mechanism, the cogged belt 5 in the illustrated embodiment for example. Carriage 6, 106, or 206 travels along a track in the form of a rail 7 comprising a length of C section like that described in WO 98/12407, which can be referred to for details. Rail 7 is fastened horizontal to lintel 4 above panel 1 and along the direction the panel opens in. A pulley 8 guides and reflects belt 5 inside rail 7. The door opening-and-closing motions of carriage 6, 106, or 206 are limited by structures in the form of stops 9 like those described in WO 98/12405, which can be referred to for details. FIGS. 1 and 3 through 7 show only the stop 9 that limits the closing motion of carriage 6, 106, or 206. Stop 9 can be clamped onto rail 7 at any desired location along it, allowing adaptation to various sites of installation and limits.

The door 2 in the illustrated embodiment is a tilting door with a single flat panel 1. The carriage 6, 106, or 206 that acts as a carrier in drive mechanism 3 is coupled to panel 1 by a coupling mechanism 10, 110, or 210. A locking mechanism 11, 111, or 211 that prevents panel 1 from being opened from outside by unauthorized persons acts in conjunction with coupling mechanism 10, 110, or 210. Coupling mechanism 10, 110, or 210 comprises a connecting rod 12 or 112 attached to carriage 6, 106, or 206 by way of a lever 13, 113, or 213 and to panel 1 by way of an L-shaped structure 14. Such an L shaped structure 14 is described in European Patent 0 768 444 A1, which can be referred to for details. Drive mechanism 3 can be adapted to various motorized door panels 1 by way of structure 14. Locking mechanism 11, 111, or 211 essentially comprises connecting rod 12 or 112 and lever 13, 113, or 213, attached to carriage 6, 106, or 206, in conjunction with stop 9. The illustrated embodiments of drive mechanism 3 differ in the design of locking mechanism 11, 111, or 211 and in the design of an emergency unlatching mechanism 40, 140, and 240 that allows the door to be opened subject to muscle power in the event of an emergency, when, for example, there is a power failure or when drive mechanism 3 malfunctions for some other reason.

Figure 2:
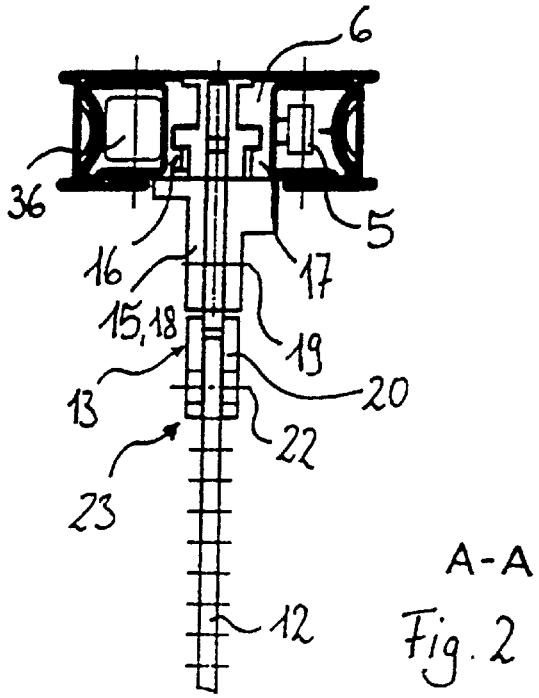
FIG. 2 is a cross-section along the line A A in FIG. 1.
Figure 3:
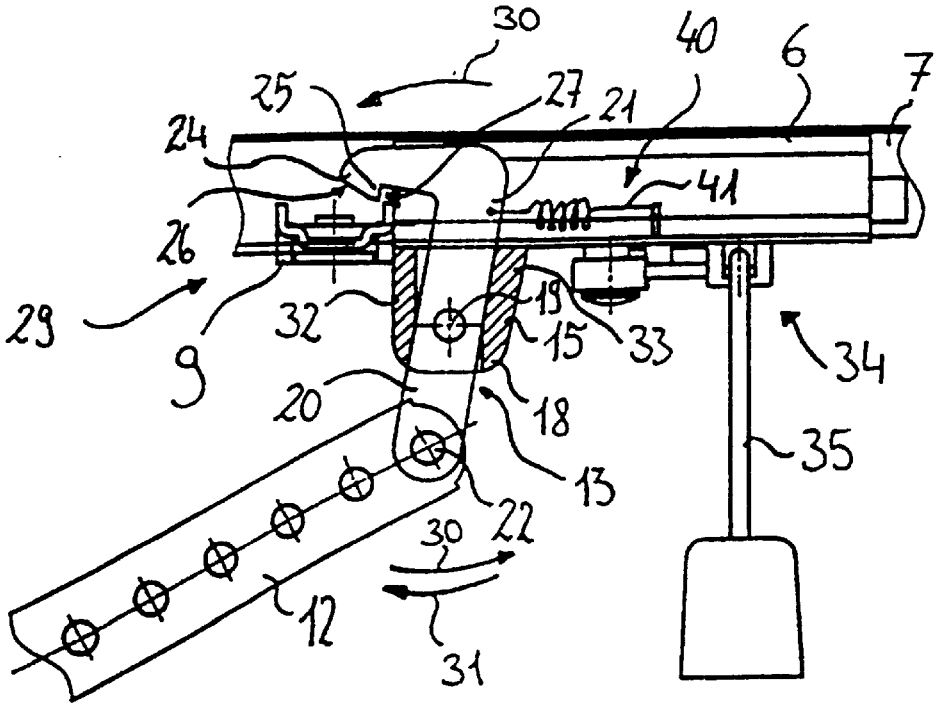
FIG. 3 is a lateral view similar to FIG. 1 of the door drive mechanism's carrier with the door closed and subject to no force.

One embodiment of the present invention will now be specified with reference to FIGS. 1 through 3.

The lever 13 in this embodiment is secured in a bearing 15 on carriage 6. Otherwise, the carriage is similar to the one described in WO 98/13569. It is accordingly provided with a groove-and-spring device 17 that includes a groove 16 and attaches it to bearing 15. The bearing is provided with a more or less sleeve-like housing 18 that extends downward from carriage 6 and wherein lever 13 pivots to a limited extent around an axis 19 that extends perpendicular to the direction traveled by the carriage. Lever 13 has two arms. One arm 20 is positioned below axis 19, and the other arm 21 above it.

Connecting rod 12 pivots around another axis 22 at the free end 23 of first lever arm 20. Specifically, free end 23 is forked, and connecting rod 12, a flat strip, is articulated between its two prongs at second axis 22. Second lever arm 21 extends initially straight out of first axis 19 but bends at an angle paralleling first pivoting direction 30, pointing upstream in the direction traveled by carriage 6 as the door opens. The free end 24 of second lever arm 21 terminates in a downward-pointing hook 25. Hook 25 is provided with an on ramp shoulder 26 facing down and along the closing-motion direction and with a capture area 27 that can engage behind a limiting edge 28 of stop 9.

The free end 24 of second lever arm 21, with its hook 25, shoulder 26, capture area 27, in conjunction with stop 9 or limiting edge 28, accordingly constitute a barbed structure that engages a component 29. By way of this engagement, locking mechanism maintains carriage 6 and panel 1 in the state represented in FIG. 1.

Whereas FIG. 1 represents engagement component 29 engaged, FIG. 3 shows it disengaged, with lever 13 subject to the tension exerted by a spring 41. The front and back walls of housing 18 are designed to allow lever 13 to pivot in first direction 30 around first axis 19 out of the disengaged position represented in FIG. 3 and into the engaged position represented in FIG. 1. As it pivots, lever 13 in second direction 31, in the opposite direction, that is, moves out of the engaged position represented in FIG. 1 and into the disengaged position represented in FIG. 3. As the lever pivots in first direction 30, the wall 32 of housing 18 near panel 1 acts as a stop, limiting the motion of second lever arm 21, and the opposite wall 33 as a stop limiting the motion of first lever arm 20. The lever's motion in second direction 31 is limited by the wall 33 farther from panel 1 on second lever arm 21 and by the wall 32 near panel 1 on first lever arm 20.

The emergency unlatching mechanism 40 in this embodiment accordingly essentially comprises the spring 41 that maintains lever 13 in its release position and a mechanism 34 that separates the carriage 6 from belt 5. Separating mechanism 34 comprises a traction cord 35 that pulls an unillustrated engagement pin (cf. FIG. 8 and hereinafter) out of its engagement with a cogged-band coupling 36 (FIG. 2) inside carriage 6. Such a cogged-band coupling is described in WO 98/13625, which can be referred to for details.

To allow its attachment to any desired points on door panel 1 and lever 13, connecting rod 12 is provided with several fastenings in the form of openings 37*a*. The connecting rod itself is a strip of sheet metal with openings 37*a* distributed equally along it. In other words it is perforated.

How this embodiment of the door-drive mechanism and its associated locking mechanism work will now be specified.

How drive mechanism 3 shifts the open door 2 into the closed state represented in the figures will be specified first. Lever 13 is initially in the position relative to bearing 15 and hence to carriage 6 represented in FIG. 1. When the free end 24 of second lever arm 21 contacts stop 9, the shoulder 26 of hook 25 slides over limiting edge 28 until capture area 27 engages behind limiting edge 28. Carriage 6 can now continue traveling until it contacts stop 9, coming to rest in the position represented in FIG. 1. Door 2 will now be closed. Drive mechanism 3 will now turn off, and lever 13 will be maintained subject to tension in the position illustrated in FIG. 3, in the release position, that is.

FIG. 1 represents what happens when an external force is applied to panel 1 in this state. When an attempt is made to lift the door from outside, a force or push 37 is applied to connecting rod 12 along its length. Due to the articulation of connecting rod 12 to first lever arm 20 accordingly, lever 13 will pivot around first axis 19 in first direction 30 until engagement component 29 arrives in its engagement position. Second lever arm 21 will now come to rest against the stop constituted by wall 32, and carriage 6 will be subjected to force in the opening direction. This force, however, will remain in action only until seizing area 27 comes to rest against limiting edge 28. Panel 1 will be prevented from moving any farther in its opening direction no matter how much force is applied to the door.

It will, however, still be possible when drive mechanism 3 malfunctions due to a power failure for instance, to open door 2 by means of emergency unlatching mechanism 40 by just uncoupling carriage 6 from belt 5 with a tug on traction cord 35 and a pull on the carrier, carriage 6, that is, in the present example, in the opening direction. As drive mechanism 3 shifts the carriage 6 in the present embodiment into the closing position against the force of spring 41, lever 13 will preferably enter its engagement position. Spring 41, which acts as an unbolting spring on lever 13, is tensioned to ensure that door 2 can be lifted and opened by muscle power immediately once carriage 6 has been unbolted. This is particularly important in the event of emergency unbolting when there is no other access to the garage. A second embodiment of door-drive mechanism 3 and a second embodiment of door-locking mechanism 111 will now be specified with reference to FIGS. 4 and 5. Identical parts will be provided with the same reference numbers, and the specification of the first embodiment can be referred to for the overall design.

Here again locking mechanism 111 is associated with a coupling mechanism 110 that couples panel 1 to a carrier in the form of a carriage 106. The carriage's motion is transferred to panel 1 by way of a lever 113 mounted therein and by way of a connector in the form of a connecting rod 112.

Lever 113 comprises two lever arms 120 and 121 that pivot in two directions 30 and 31 around an axis 119 inside rail 7.

Figure 5:
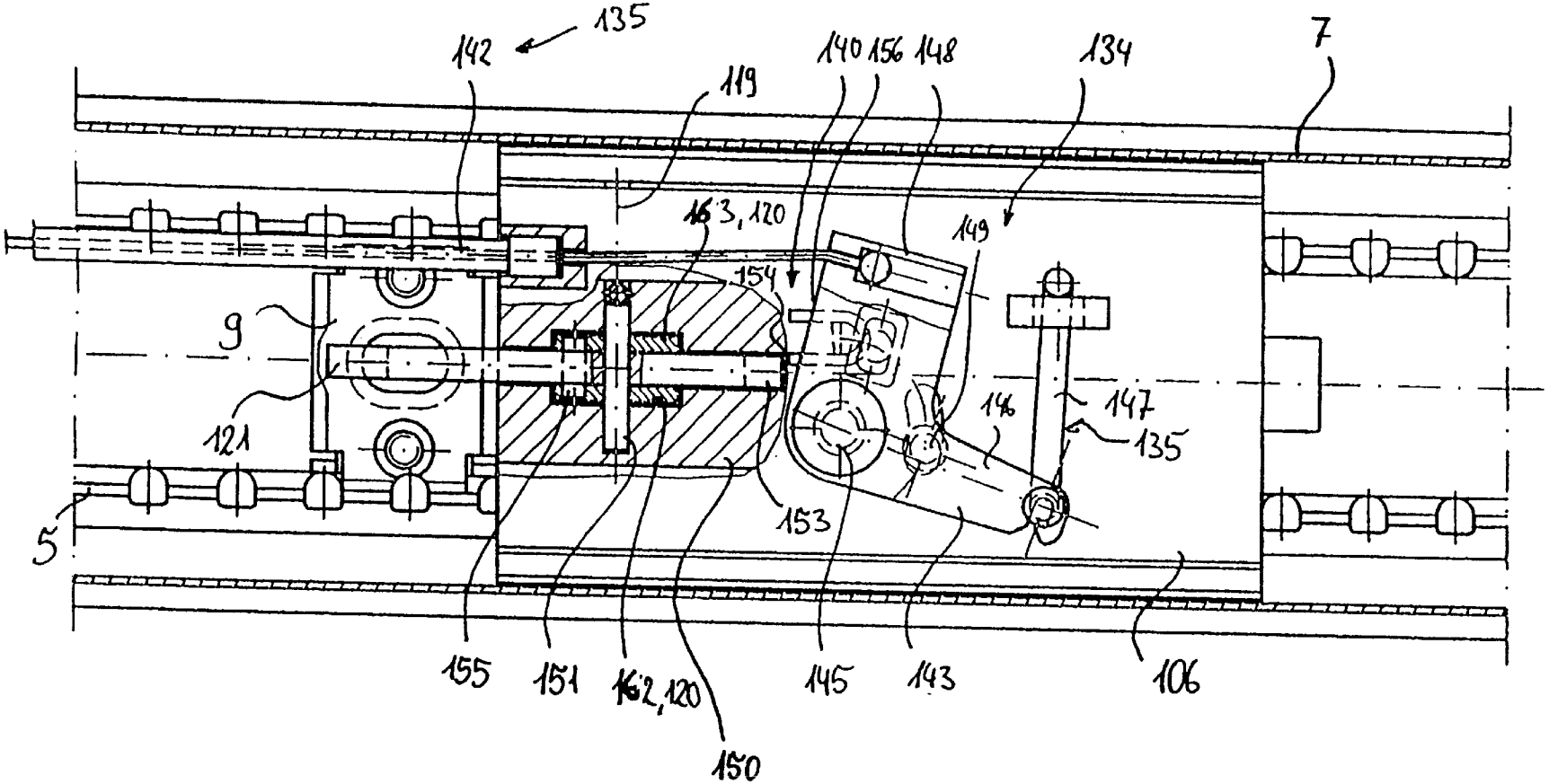
FIG. 5 is a view of the second embodiment from below along the direction indicated arrow A in FIG. 4.

Axis 119 is embodied by a pin 151 mounted in the carriage's housing 150 (FIG. 5). Pin 151 extends through lever arms 120 and 121. First lever arm 120 is constituted by two cheeks 162 and 163, in the form of strips of metal in the present embodiment, one on each side of second lever arm 121 and connecting rod 112. Connecting rod 112 pivots between and at the free ends 123 of cheeks 162 and 163 around another axis 122 below rail 7.

The free end 124 of second lever arm 121 is provided with a hook 125 similar to the hook 25 in the first embodiment, with that is, an on-ramp shoulder 126 and an edge 127 that engages a limiting stop 9. Second lever arm 121 is in the form of a length of structural section mounted on pin 151 that could as a whole be called a locking hook or locking-hook component and that extends along second lever arm 121 and beyond first axis 119, accordingly constituting a third arm 152 for lever 133. Third lever arm 152 bends down at its free end 153. Between first lever arm 120 and the bent-down free end 153 of third lever arm 152 is a resilient structure, in the form of a compression spring 144 in the present example. Compression spring 144 tensions second lever arm 121 and third lever arm 152 with its locking hook in first direction 30 and accordingly maintaining second lever arm 121 in the engagement position represented in FIG. 4.

The end of third lever arm 152 pointing away from first axis 119 is provided with an emergency unlatching mechanism 140 in the form of a contact area 154 that engages an unlocking lever component 143.

Figure 4:
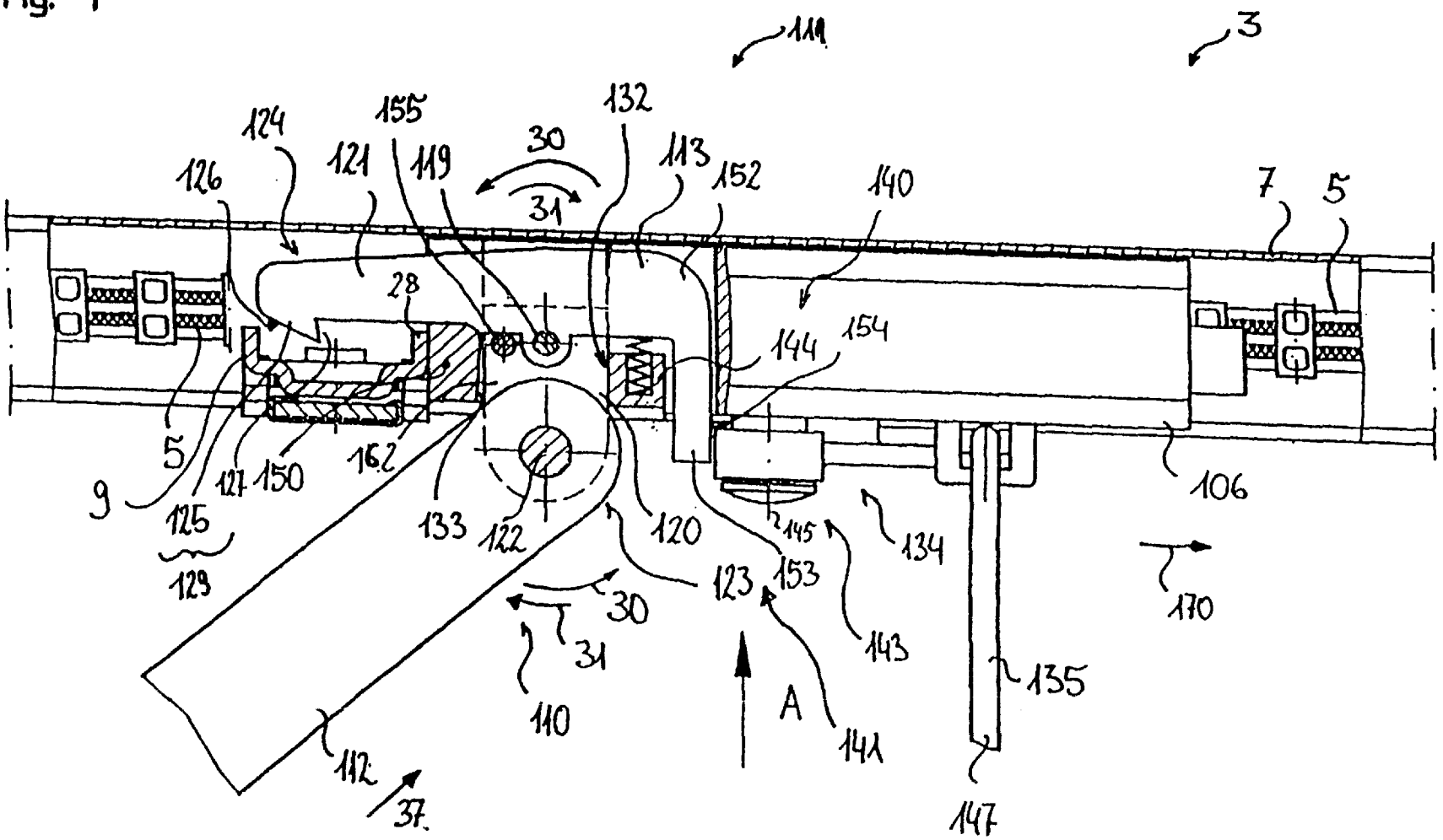
FIG. 4 is a partly sectional lateral view similar to FIG. 1 of part of another embodiment of a door-drive mechanism and locking mechanism.

Carriage housing 150 is provided with inner surfaces 132 and 133 that act as stops, limiting the pivoting motion of first lever arm 120, cheeks 162 and 163, that is. First lever arm 120 is also provided with a carrier 155 with a pin mounted between the cheeks. Carrier 155 is mounted on first lever arm 120 where it engages second lever arm 121 in the position represented in FIG. 4. FIG. 4 shows lever 113 in its engagement position, with lever arms 120 and 121 pivoted in first direction 30, wherein a push 37 is being exerted on connecting rod 112. As first lever arm 120 pivots in second direction 31, carrier 155 will move second lever arm 121, which accordingly shifts out of its engagement position and into an unillustrated release position.

Emergency unlatching mechanism 140 permits the door 2 to be opened by muscle power. The mechanism essentially comprises, first, a mechanism 141 that unlocks the locking lever along with its second lever arm 121 and, second, a mechanism 134 that separates a coupling between carriage 106 and means 5 of applying tension.

The unlocking mechanism includes unlocking-lever component 143, which can by way of contact area 154 pivot third lever arm 152 and hence second lever arm 121 in second direction 31 and accordingly into its release position. Separating mechanism 134 also includes unlocking-lever component 143, which can, before locking mechanism 111 has been unlocked by releasing second lever arm 121, extract the spring-loaded engagement pin out of its engagement with cogged-band coupling 36.

As will be most evident from FIG. 5, unlocking-lever component 143 pivots around a third axis 145 perpendicular to direction traveled by carriage 106. The free end of the first lever arm 146 of unlocking-lever component 143 is engaged by one component of a traction means in the form of a cable bell 147 that can be actuated from inside the premisses being closed off. Another lever arm 148 is engaged by another component of the traction means in the form of a Bowden cord 142 that can be actuated from outside the premisses. Applying tension to Bowden cord 142 or cable bell 147 will pivot unlocking-lever component 143 around third axis 145. As unlocking-lever component 143 pivots, a pin 149 that travels back and forth in a curved slot will extract the engagement pin out of engagement with the cogged-band coupling, whereupon, once a detachment position has been attained, carriage 106 will be uncoupled from cogged belt 5. As unlocking-lever component 143 pivots out of the normal position represented in FIG. 5, a contact vicinity 156 on the second lever arm 148 of unlocking-lever component 143 will also engage the contact area 154 located in that normal position at some distance from contact vicinity 156, unlocking second lever arm 121. How this second embodiment of locking mechanism 111, illustrated in FIGS. 4 and 5, operates will now be specified.

FIG. 4 shows the state of the locking mechanism while door 2 is closed. Carriage 106 is resting against limiting stop 9, lever arms 120 and 121 have pivoted in first direction 30, and lever 113 is in its engagement position. When an exterior force 37 is applied to panel 1, carriage 106 will be shifted in the opening direction until the engagement component 129 constituted by second lever arm 121 with its hook 125 and engagement section 127 engages the limiting edge 28 of stop 9. Further motion of carriage 106 and hence further opening of panel 1 subject to exterior force will be impossible.

When door-drive mechanism 3 is actuated, cogged belt 5 will drag carriage 106 in opening direction 170. The resulting traction on connecting rod 112 will pivot first lever arm 120 in second direction 31. Carrier 155 will engage, and lever arms 120 and 121 will pivot in second direction 31, shifting the mechanism out of the engagement position represented in FIG. 4 and into the release position. With locking mechanism 111 unlocked, accordingly, carriage 106 can now travel in opening direction 170 until door 2 is all the way open. As the door closes, carriage 106 will move in the direction opposite opening direction 170. First lever arm 120 will pivot in first direction 30 into the position represented in FIG. 4, coming to rest against interior wall surface 132. Panel 1 can now be closed by way of carriage 106. Second lever arm 121 will, subject to the force exerted by compression spring 144, pivot into the engagement position represented in FIG. 4. Once on-ramp shoulder 126 reaches limiting edge 28, second lever arm 121 will be forced to pivot in second direction 31 against the force exerted by spring 144 but without being accompanied by connecting rod 112 until engagement section 127 travels beyond limiting edge 28. Carriage 106 will continue moving until it comes to rest against limiting stop 9.

When emergency unbolting is necessary, a tug on cable bell 147 from inside or on Bowden cord 142 from outside will actuate them manually. Bowden cord 142 terminates in a space not accessible to unauthorized persons outside the premisses being closed off. This is of particular importance when access to the premisses is only by way of the doorway.

The tug causes unlocking-lever component 143 to pivot, detaching carriage 106 from cogged-band coupling 36. Contact vicinity 156 engages the contact area 154 of the bent-down free end 153 of third lever arm 152, forcing second lever arm 121 out of its engagement position. Since lever arms 120 and 121 are separated, they will both be uncoupled, and engagement component 129 can be shifted out of its engagement position without first lever arm 120 having to move. Door 2 can now be lifted by muscle power.

Due to the uncoupling of lever arms 120 and 121, it is unnecessary to adjust locking mechanism 111 to various situations as precisely as in the prior art. The second embodiment of locking mechanism 111 is particularly outstanding in that the lever comprising second lever arm 121 and third lever arm 152 is maintained in its engagement position or in its bolting position by a compression spring for example. This lever, which can be considered a locking hook, pivots around first axis 119. A mechanism, in the form of cheeks 162 and 163 in this case, that attaches panel 1 to the closing rod, or connecting rod 112, pivots around first axis 119 to a limited extent. Locking-hook lever 121 and 152 and cheeks 162 and 163 or a similar pivoting mechanism for attaching connecting rod 112 can be pivoted mutually to a certain extent around first axis 119. This pivoting motion is limited by carrier 155, a carrier pin, that forces locking hook lever 121 and 152 out of the bolting position or engagement position when connecting rod 112 and carriage 106 apply traction to each other and as cheeks 162 and 163 pivot.

A lever system 134, 143, and 140 is available for emergency unbolting. This system can be employed to force locking-hook lever 121 and 152 out of its engagement position against the force of spring 144, subsequent to which door 2 can be lifted by muscle power.

The illustrated embodiment of locking mechanism 111, which prevents break-ins and keeps the door closed, includes locking-hook lever 121 and 152 and two cheeks 162 and 163 connected together by a pin 155 that constitutes the carrier.

Locking-hook lever 121 and 152 is maintained in its closing position by compression spring 144. This lever pivots along with cheeks 162 and 163 and carrier pin 155 around first axis 119. First axis 119 is accommodated and prevented from axial displacement by pin 151. FIG. 4 represents the door-closing state.

As they travel during the door-closing state, the cheek surfaces extending along the carriage's opening and closing directions rest against matching carriage-guidance surfaces-interior wall surfaces 132 and 133. Locking-hook lever 121 and 152 is in its closing or engagement position. Just prior to the door-closing state, the locking nose or hook 125 in locking-hook lever 121 and 152 will arrive at the elevated edge 28 of stationary limiting stop 9 and will accordingly rise. Once hook 125 has traveled beyond this edge, compression spring 144 will force it back into its closing or engagement position.

As they travel in door-opening direction 170, cheeks 162 and 163 will pivot around first axis 119, carrier pin 155 carrying locking-hook lever 121 and 152 along with it. Locking-hook lever 121 and 152 will accordingly pivot around first axis 119, and hook 125 will rise. The door-opening motion will be unimpeded. Emergency unbolting, in the event of malfunction on the part of drive mechanism 3 for instance, can be initiated from outside by way of Bowden cord 142 or from inside by way of cable bell 147 or of a similar traction cord. Both cable bell 147 and Bowden cord 142 engage unlocking-lever component 143, which pivots around the essentially vertical axis 145. When tension is applied to either of these traction means, unlocking-lever component 143 will pivot around axis 145. When unlocking-lever component 143 is actuated, its contact vicinity 156 will apply force to the oppositely directed contact area 154 of locking-hook lever 121 and 152. The locking-hook lever will thereupon be shifted out of its closing or engagement position. Another mechanism could also be employed to maintain the unlocking-lever component unlocked following emergency unbolting, although this embodiment is not illustrated. Door 2 can be opened by muscle power once locking-hook lever 121 and 152 has been unlocked.

Figure 6:
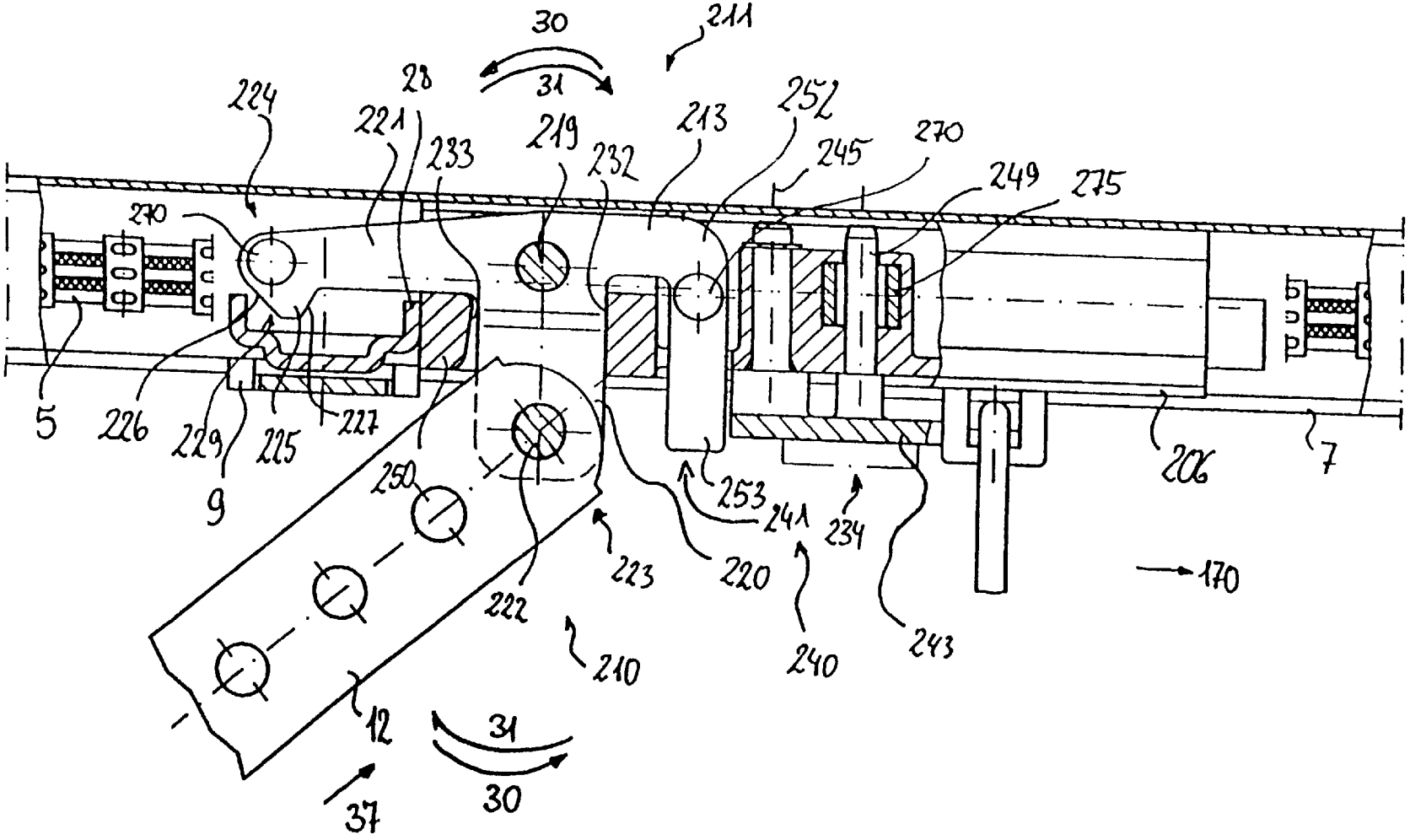
FIG. 6 is a view similar to FIGS. 3 and 4 of a third embodiment of a door-drive mechanism and locking mechanism.
Figure 8:
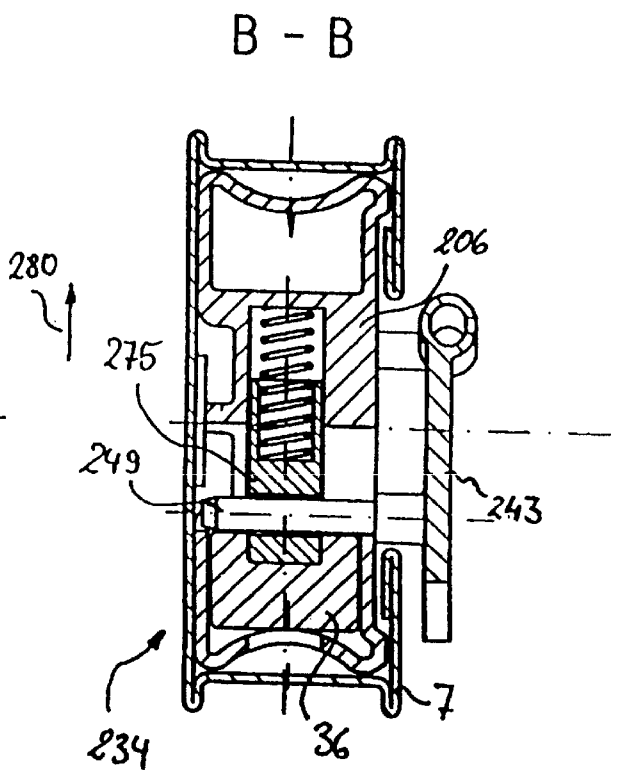
FIG. 8 is a cross-section along the line B—B in FIG. 2.
Figure 7:
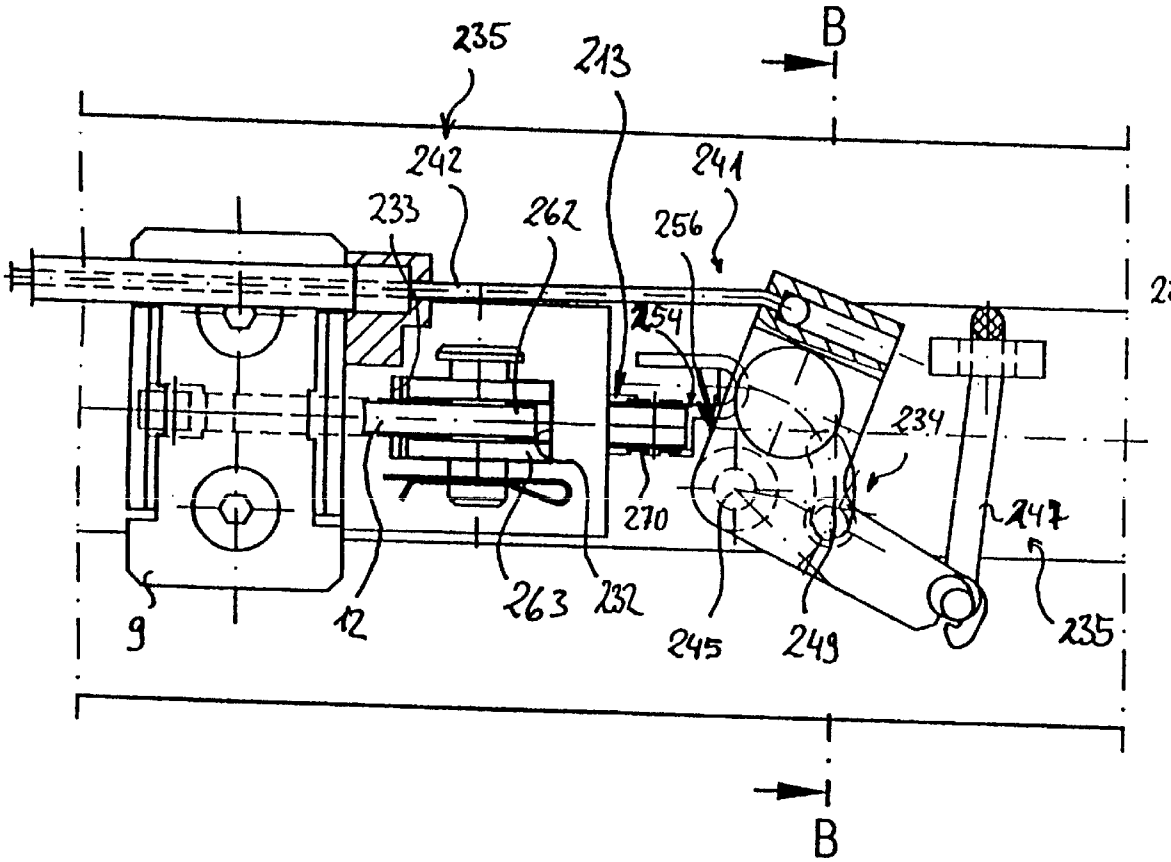
FIG. 7 is a view from below of the part of the third embodiment of a door-drive mechanism and locking mechanism illustrated in FIG. 6.

FIGS. 6 through 8 illustrate a third embodiment of a door drive mechanism and locking mechanism 211. Identical parts will be provided with the same reference numbers.

The locking mechanism 211 illustrated in FIGS. 6 through 8 includes a coupling mechanism 210 for coupling panel 1 to a carriage 206 and a connecting rod 12 that is coupled to the carriage by way of a lever 213 that pivots to a limited extent around a first axis 219. Lever 213 has three arms 220, 221, and 252. Connecting rod 12 pivots around another axis 222 at the free end of first arm 220. The free end of second arm 221 is provided with an engagement component 229 with a nose 225. Third arm 252 is similar to third arm 252 [sic] and is provided with a bent down end 253 with an edge that engages an unlocking-lever component 243.

As will be evident from FIG. 7, lever 213 comprises two flat components united by rivets 270. The areas of the components that constitute first arm 220 are offset, creating two cheeks 262 and 263 that enclose the lever's point of attachment to connecting rod 12.

Nose 225 is provided with an engagement section 227. Unlike engagement sections 27 and 127, however, section 227 is bent down obliquely rather than acutely. Nose 225 is also provided with an on-ramp shoulder 226.

Emergency unlatching mechanism 240 comprises a component 241 for unlocking a locking mechanism 211 and a mechanism 134 for separating carriage 206 from cogged belt 5. Separating mechanism 234 and emergency unlatching mechanism 240 are essentially constituted by an unlocking-lever component 243 similar to unlocking-lever component 143.

Unlocking-lever component 243 can be pivoted around a third axis 245 by way of traction means 235 that comprises a cable bell 247.

Comparing FIGS. 5 and 7 will reveal the differences between the emergency unlatching mechanism 240 or, more specifically, unlocking mechanism 241 employed in the second embodiment and the emergency unlatching mechanism 140 and unlocking mechanism 141 employed in the third embodiment. It will be evident that the curved slot that pin 149 or 249 travels in as it uncouples carriage 106 or carriage 206 from cogged-band coupling 36 is longer in the third embodiment and that the distance between the contact vicinity 256 on unlocking-lever component 243 and the contact area 254 on the third lever arm is longer than the distance between the contact vicinity 156 and the contact area 154 in the second embodiment.

Separating mechanism 234 will now be specified with reference to FIG. 8, which shows a coupling-or-engagement pin 275 similar to the ones discussed in relation to the two aforesaid embodiments and employed to couple carriage 206 to cogged-band coupling 36. The pin 249 in unlocking-lever component 243 extends through pin 275.

How the third embodiment of the locking mechanism operates will now be specified.

FIG. 6 represents locking mechanism 211 in the door-closing state. When drive mechanism 3 is actuated, cogged belt 5 will move carriage 206 in the opening direction 170. The resulting traction on connecting rod 12 will pivot lever 213 around first axis 219 in second direction 31. The pivoting motion is limited by a stop in the form of an inner wall surface 233 of carriage housing 250. As carriage 206 continues to move in the opening direction 170, the door will open. With lever 213 resting against the inner wall surface 233 of housing 250, second arm 221 will be unlocked, and engagement component 229 will be in its release position. The door can be opened unimpeded.

If the motion of drive mechanism 3 is reversed, lever 213 will, due to the pushing force applied to connecting rod 12, pivot in first direction 30 into the position illustrated in FIG. 6, with first arm 220 resting against a first stop in the form of one interior wall surface 232 of carriage housing 250. The door will then close due to the accordingly established interlocking connection between connecting rod 12 and carrier 206. Once on-ramp shoulder 226 has arrived at the stop's limiting edge 28, lever 213 will pivot until nose 225 can slip over edge 28 and into the engagement position represented in FIG. 8. The closing motion will continue until carriage 206 arrives at limiting stop 9. The door is closed. If force is applied to the door from outside, it will act as a push 37 against connecting rod 12. Carriage 206 will accordingly also be pushed in opening direction 170 until engagement section 227 arrives at limiting edge 28. Even though engagement section 227 is not pointed, limiting edge 28 cannot be conquered because push 37 will be forcing lever 213 into its engagement position. The oblique slope toward limiting edge 28, however, has the advantage that nose 225 cannot hook over edge 28 even subject to powerful closure forces. The obliquity also decreases wear.

Although the arms 220 and 221 in the third embodiment are in one piece in contrast to the arms in the second embodiment, emergency unbolting will still be simple and reliable. This is ensured in the third embodiment in that carriage 206 is initially uncoupled from cogged belt 5 and in that, due to the longer distance between contact vicinity 256 and contact area 254, lever 213 cannot be forced out of engagement until uncoupling is complete. Since carriage 206 has been entirely uncoupled by this time, lever 213 having already pivoted in second direction 31, allowing emergency unbolting, the displacement between carriage 206 and connecting rod 12 needed for the pivoting motion can be initiated without further measures by the travel of carriage 206 along rail 7.

Locking mechanism 211 can accordingly be very easily unlocked by way of emergency unlatching mechanism 240, and the door can be opened by muscle power.

The locking mechanism.211 in the third embodiment is accordingly provided with a locking hook in the form of lever 213 that pivots around first axis 219. Axis is accommodated in the carriage 206 attached to door panel 1 and prevented from axial displacement by an unillustrated cam. FIG. 6 shows the mechanism in the door-closed state.

As the locking hook constituted by lever 213 travels in the door-closing direction, the surfaces of its cheeks 262 and 263 that face along opening direction 170 will come to rest against a surface constituted by the interior wall surface 232 of carriage 206. The locking hook, lever 213, is now in its closing or engagement position. Just before arriving at the door-closed position, the nose 225 of the locking hook or lever 213 will encounter the elevated limiting edge 28 of stop 9 and will accordingly be lifted. Once nose 225 has traveled past limiting edge 28, the closing force exerted by door 2 will return the edge to its engagement position.

As it travels in the door-opening direction, the lever 213 that constitutes the locking hook will pivot around first axis 219, lifting nose 225. The cheeks 262 and 263 of lever 213 will simultaneously come to rest against inner wall surface 233.

Emergency unbolting is accomplished from outside by means of Bowden cord 242 or from inside by means of cable bell 247. Unlocking-lever component 243 can pivot around third axis 245. Actuation of unlocking-lever component 243 will initially cause the pin 249 to shift the spring-loaded slide or the coupling-or-engagement pin 275 in direction 280, disengaging carriage 206 from the cogged-band coupling 36 with cogged belt 5. Further actuation of unlocking-lever component 243 will close the distance between the contact vicinity 256 of unlocking-lever component 243 and the contact area 254 of lever 213, and contact vicinity 256 will apply force to contact area 254. The locking hook constituted by lever 213 will pivot in the second direction around first axis 219, and nose 225 will be lifted. The system is now unlocked and the door can be opened by muscle power.

The third embodiment is particularly outstanding in that it operates in two phases, with unbolting, i.e. the separation of the carriage from the motorized transmission, independent of unlocking, i.e. separation of the carriage from the stationary limiting stop.

The nose 225 on the lever 213 that constitutes the locking hook is not pointed. This prevents carriage 206 from hooking up as it travels in the door-opening direction in doors with powerful closing forces.

The particular characteristics of the individual embodiments specified herein can, unless obviously inapplicable, be combined in various ways to create additional embodiments.

What is claimed is:

1. A locking mechanism for an overhead door driven by a motorized transmission, said overhead door being one of a tilting, swinging, or sectional door; a coupling mechanism coupling a panel of said door to a carrier; said transmission moving said carrier back and forth for preventing a closed door from opening when not subjected to force by said carrier; a lever and a connector, said lever being mounted on said carrier and pivoting around a first axis in two opposite directions; said lever having an engagement mechanism engaging a stationary counterbearing operating in conjunction with a track for guiding said carrier in locking the door, said engagement mechanism engaging said counterbearing as said lever pivots in one direction and disengages said counterbearing as the lever pivots in the opposite direction, said connector being rigid and in form of a connecting rod having an attachment mechanism at one end for attaching to said door panel and being pivoted at the other end to said lever around another axis at a distance from said first axis, said lever pivoting around said first axis in a first direction when said connector is pushed while in alignment with the door and pivoting in the opposite direction when said connector is pulled while in alignment with the door; said lever comprising two arms, said connector being attached to said first arm, said engagement mechanism engaging said counterbearing while said lever and thereby said second arm pivots in said first direction and pushes said connector attached to the door, said engagement mechanism disengaging from said counterbearing while said lever and thereby said second arm pivots in said opposite direction and pulls the connector attached to the door.

2. A locking mechanism as defined in claim 1, wherein said second lever arm has an end pointing along the first pivoting direction with said engagement mechanism in form of a hook engaging behind said counterbearing while said lever pivots in the first direction and releasing said counterbearing while said lever pivots in the second direction.

3. A locking mechanism as defined in claim 1, including two stops, a first one of said stops limiting motion of said lever when pivoting in the first-direction once engagement has been achieved and the second one of said stops limiting motion of said lever when pivoting in the second direction once engagement has been achieved.

4. A locking mechanism as defined in claim 1, including an emergency unbarring mechanism disengaging said lever for allowing the door to be opened manually.

5. A locking mechanism as defined in claim 4, wherein said emergency unbarring mechanism unlocks the locking mechanism and uncouples said door panel and comprises said motorized transmission-with a separating mechanism separating said carrier from said motorized transmission.

6. A locking mechanism as defined in claim 5, wherein said separating mechanism has an unlocking-lever component for manually shifting said carrier out of a normal position wherein said carrier is coupled to said motorized transmission, and into a detachment position wherein said carrier is detached from said it motorized transmission by traction means.

7. A locking mechanism as defined in claim 4, wherein said emergency unbarring mechanism includes means of applying tension in form of a spring maintaining said lever in a release position.

8. A locking mechanism as defined in claim 4, wherein said emergency unbarring mechanism includes an unlocking mechanism for shifting said lever out of an engaged locking position, so that said door panel can be pulled or pushed up.

9. A locking mechanism as defined in claim 8, wherein said unlocking mechanism has means so that when the emergency unlatching mechanism is actuated said second lever arm will not pivot out of an engagement position and into a release position until the separating mechanism has separated said carrier.

10. A locking mechanism as defined in claim 9, wherein said unlocking mechanism is mounted on said unlocking-lever component so that when said unlocking-lever component pivots out of its normal position and beyond its unlocking position said unlocking mechanism will not seize a vicinity of said lever that pivots along with said second lever arm so that said second lever arm will pivot in the second direction until said unlocking-lever component has traveled beyond an unlocking position.

11. A locking mechanism as defined in claim 10, wherein a contact area of said lever has a third lever arm connected to and pivoting along with said second lever arm around said first axis and extending into a vicinity wherein said unlocking-lever component pivots so that, when said lever is in an engagement position and said unlocking-lever component is in a normal position, said third lever arm will be far enough from one arm of said unlocking-lever component to prevent said unlocking-lever component and said third lever arm from seizing each other until said unlocking-lever component has pivoted out of said normal position and beyond an unlocking position.

12. A locking mechanism as defined in claim 8, wherein said unlocking mechanism comprises said unlocking-lever component pivotable manually by traction means connected to a coupling pin and having a contact vicinity, said coupling pin being tensioned in a coupling position and coupling said carrier to said traction means, whereby when pivoting into an unlocking position said unlocking-lever component releases said coupling pin, and whereby said contact vicinity encounters a matching contact area on said lever and pivoting thereby said second lever arm out of an engagement position and into a release position.

13. A locking mechanism as defined in claim 12, wherein said engagement mechanism has an obliquely angled capture area for seizing said counterbearing.

14. A locking mechanism as defined in claim 1, including a bearing accommodating said lever and extending downward from said carrier, whereby said carrier travels back and forth along a track extending horizontally above a route traveled by the door panel as the door opens, said first axis being against said bearing-extending downward as viewed from a specified angle and at a distance from the horizontal track, whereby said bearing has a housing in form of sleeve means.

15. A locking mechanism as defined in claim 1, wherein said first axis is inside said carrier, whereby said stops comprise an interior wall surfaces of said carrier.

16. A locking mechanism as defined in claim 1, wherein said first lever arm extends downward from said first axis when pivoting in said first direction, said free end moving in an opening direction traveled by said carrier.

17. A locking mechanism as defined in claim 1, wherein said second lever arm extends upward from said first axis when said second arm pivots in said first direction and said free end thereof moves along with the engagement mechanism opposite a direction traveled by said carrier as the door opens.

18. A locking mechanism as defined in claim 1, wherein said lever arms comprise a single component pivoting in both directions.

19. A locking mechanism as defined in claim 1, wherein said first and second lever arms are separate components coupled together by way of a carrier mechanism so that said second lever arm moves along with said first lever arm when the latter pivots in one of the two directions, said second lever arm being subjected to tension along with the carrier in a capture position whereby both lever arms engage each other through the carrier when force is exerted against said second lever arm in opposition to the capture.

20. A locking mechanism as defined in claim 1, wherein said first and second lever arms pivot simultaneously as said carrier travels in opening direction and uncouple from each other by pivoting relative to each other as said carrier travels in closing direction.

21. A locking mechanism as defined in claim 1, wherein said second lever arm is tensioned by a spring in an engagement position.

22. A locking mechanism as defined in claim 1, wherein the free end of said second lever arm is bent along the first pivoting direction relative to said first lever arm to form said hook, whereby a face of the bent free end facing the first direction has a hook nose with an engagement area seizing the counterbearing and locking said counterbearing.

23. A locking mechanism as defined in claim 1, wherein said engagement mechanism has a snap-in nose in form of a hook nose, whereby a side of said snap-in nose facing an engagement area has an on-ramp shoulder.

24. A locking mechanism as defined in claims 1, wherein said counterbearing is fastenable at various points along said track.

25. A locking mechanism as defined in claim 24, wherein said track is a rail in form of a length of C section, said counterbearing being tensioned from one mutually facing edge to the other.

26. A locking mechanism as defined in claim 1, wherein said counterbearing comprises a limiting mechanism that limits the closing motion of said carrier to define a closing position.

27. A locking mechanism as defined in claim 1, wherein said counterbearing comprises one edge of a limiting mechanism and extending into a C section.

28. A locking mechanism as defined in claim 1, wherein said connecting rod has means for attaching to any desired point on said door panel and for articulating to any desired point on said first lever arm for allowing various distances between the door panel and said carrier to be spanned in accordance with a site of installation.

29. A locking mechanism as defined in claim 28, wherein said connecting rod is flat and elongated and comprises a perforated strip of metal, whereby said means of attaching to any desired point on the door panel and of articulating to any desired point on said first lever arm are in form of a plurality of round holes.

* * * * *